US008342047B1

(12) United States Patent
Lusch

(10) Patent No.: US 8,342,047 B1
(45) Date of Patent: Jan. 1, 2013

(54) RATCHET STYLE ANTI-BACK DEVICE FOR CONVEYOR DOLLIES

(75) Inventor: Rodger Lusch, Prospect, OH (US)

(73) Assignee: Honda Motor Co., Ltd., Tokyo (JP)

( * ) Notice: Subject to any disclaimer, the term of this patent is extended or adjusted under 35 U.S.C. 154(b) by 1141 days.

(21) Appl. No.: 12/212,174

(22) Filed: Sep. 17, 2008

(51) Int. Cl.
*F16H 35/18* (2006.01)
*F16D 63/00* (2006.01)
*G05G 1/04* (2006.01)

(52) U.S. Cl. ..... 74/10.2; 74/10.29; 74/10.31; 74/526; 188/82.1

(58) Field of Classification Search ..... 104/250–253; 188/82.1; 74/567–569, 511 R, 525–527, 74/10.2, 545, 10.29, 10.31; 312/267; *B65G 35/06; G05G 1/04*
See application file for complete search history.

(56) References Cited

U.S. PATENT DOCUMENTS

| | | | | | |
|---|---|---|---|---|---|
| 3,011,456 | A | * | 12/1961 | Lyons | 104/172.4 |
| 3,486,386 | A | * | 12/1969 | Laubenfels | 74/10.2 |
| 3,536,169 | A | * | 10/1970 | Arnold | 188/82.1 |
| 3,759,189 | A | | 9/1973 | Desilets | |
| 4,326,466 | A | | 4/1982 | Parry et al. | |
| 4,790,247 | A | | 12/1988 | Summa | |
| 5,192,122 | A | * | 3/1993 | Hill | 312/267 |
| 5,325,790 | A | | 7/1994 | Drayer | |
| 5,359,940 | A | | 11/1994 | Van Lierde | |
| 5,715,756 | A | | 2/1998 | Weigand et al. | |
| 5,738,017 | A | | 4/1998 | Behringer | |
| 5,839,548 | A | * | 11/1998 | Parker et al. | 188/82.1 |
| 5,884,564 | A | | 3/1999 | Fountas | |
| 6,041,676 | A | * | 3/2000 | Bettenhausen | 74/545 |
| 2004/0119351 | A1 | * | 6/2004 | Schwarzli | 310/75 R |
| 2006/0070483 | A1 | * | 4/2006 | Dimsey | 74/525 |
| 2011/0192251 | A1 | * | 8/2011 | Lockett, Jr. | 74/511 R |

FOREIGN PATENT DOCUMENTS

JP 54-151287 * 11/1979

OTHER PUBLICATIONS

English Abstract of JP 54-151287.*

* cited by examiner

*Primary Examiner* — Vinh T. Luong
(74) *Attorney, Agent, or Firm* — Rankin Hill & Clark LLP

(57) ABSTRACT

An anti-backup device for a power conveyor system is provided and includes a mounting plate, a mounting shaft, a spline cut cog, a multi-position cam, and a bias spring. Both the spline cut cog and the multi-position cam have multiple teeth that engage each other to permit rotation of the multi-position cam in a forward direction and prevent rotation of the multi-position cam in a backward direction.

16 Claims, 4 Drawing Sheets

RATCHET STYLE ANTI-BACK DEVICE FOR CONVEYOR DOLLIES

BACKGROUND OF THE INVENTION

1. Field of the Invention

The present invention relates to a conveyor belt for dollies and more specifically to an anti-backup device to prevent the dollies from moving in a reverse direction.

2. Description of Related Art

In power conveyor systems with dollies or carriers problems arise when the conveyor system in not in motion. Specifically, the carriers, when not moving in a forward direction, tend to move in a backward direction thereby slamming into adjacent carriers. Thus, the carriers and any material transported by the carriers become damaged to some extent thereby increasing production time and costs.

Thus, what is required is a device that prevents the carriers in a power conveyor system from moving in a reversed direction to thereby prevent damage to the carriers and/or material transported by the carriers.

SUMMARY OF THE INVENTION

In accordance with one aspect, the present invention overcomes the above mentioned disadvantages by providing a power conveyor device for a power conveyor system comprising a mounting plate removably attached to a conveyor track, a mounting shaft fixedly connected to the mounting plate, a bevel gear fixedly attached to the mounting shaft, the bevel gear having multiple teeth projecting out at a right angle from a front surface of the bevel gear, a multi-position cam rotatably attached to the mounting shaft, the multi-position cam having multiple teeth projecting out at a right angle from a rear side of the multi-position cam, a bias spring operatively mounted on the mounting shaft to bias the multi-position cam against the bevel gear, and a fastening device to secure the multi-position cam and the bias spring to the mounting shaft, whereby the multi-position cam rotates only in a forward direction.

In accordance with another aspect, the present invention provides an anti-backup device for a power conveyor system comprising a mounting plate removably attached to a conveyor track, a mounting shaft fixedly connected to the mounting plate, a spline cut cog fixedly attached to the mounting shaft, the spline cut cog having multiple teeth projecting out at a right angle from a front surface of the spline cut cog, a multi-position cam rotatably attached to the mounting shaft, the multi-position cam having multiple teeth projecting out at a right angle from a rear side of the multi-position cam, a bias spring operatively mounted on the mounting shaft to bias the multi-position cam against the spline cut cog, and a fastening device to secure the multi-position cam and the bias spring to the mounting shaft. The teeth on the multi-position cam engage the teeth on the spline cut cog in such a manner as to permit rotation of the multi-position cam in a forward direction and prevent rotation of the multi-position cam in a backward direction.

Additional benefits and advantages of the present invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings that form a part of the specification.

DETAILED DESCRIPTION OF THE INVENTION

Figure 1:
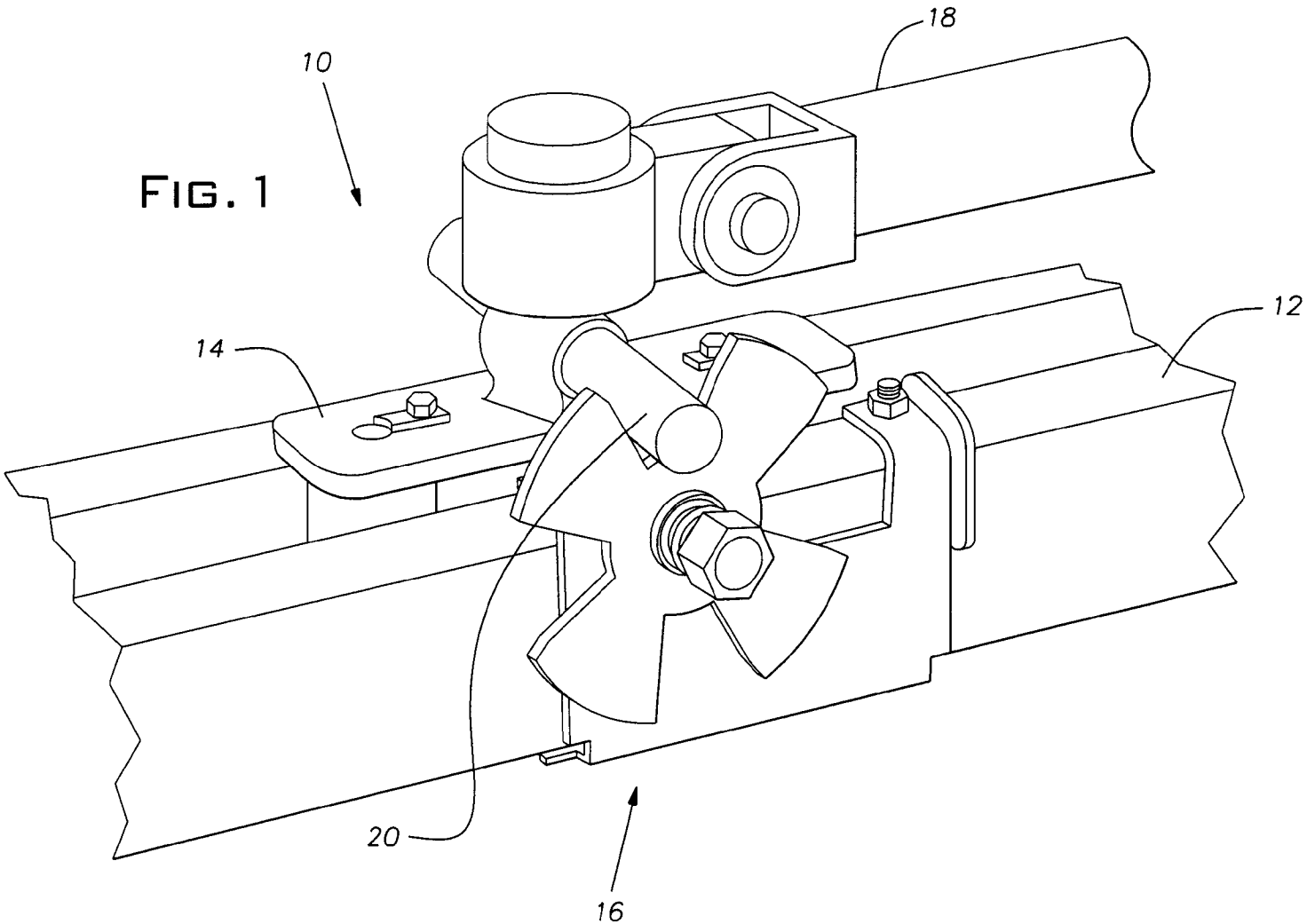
FIG. 1 is a partial view of a power conveyor system.
Figure 4:
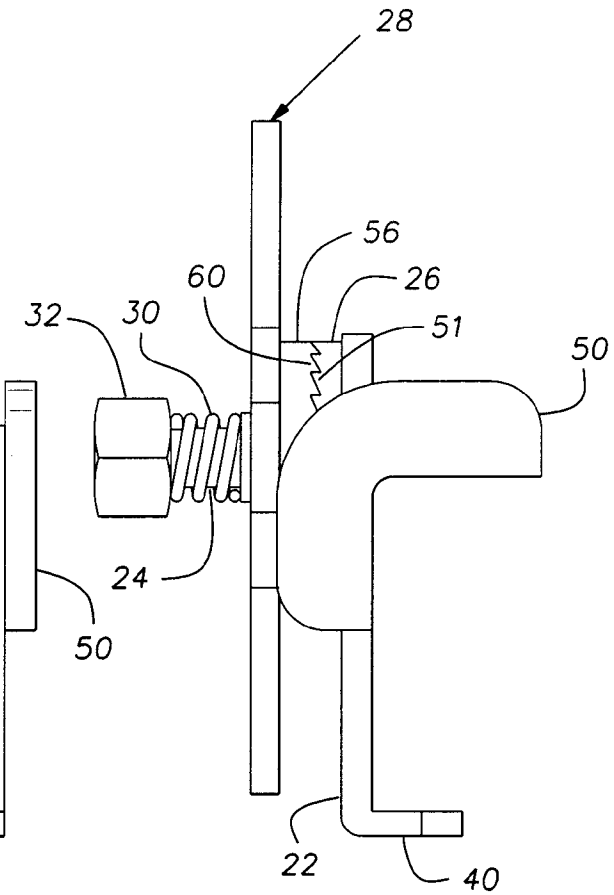
FIG. 4 is an angled side view of the anti-backup device.
Figure 2:
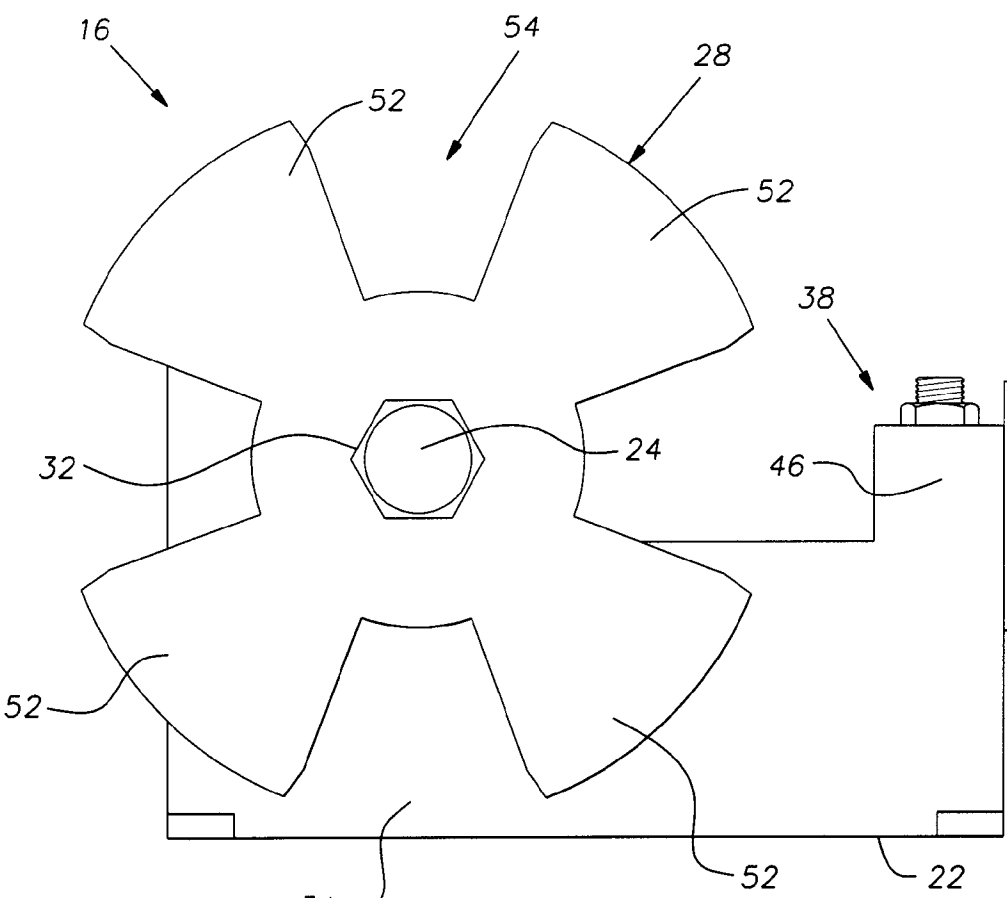
FIG. 2 is a front view of an anti-backup device in accordance with the present invention.
Figure 3:
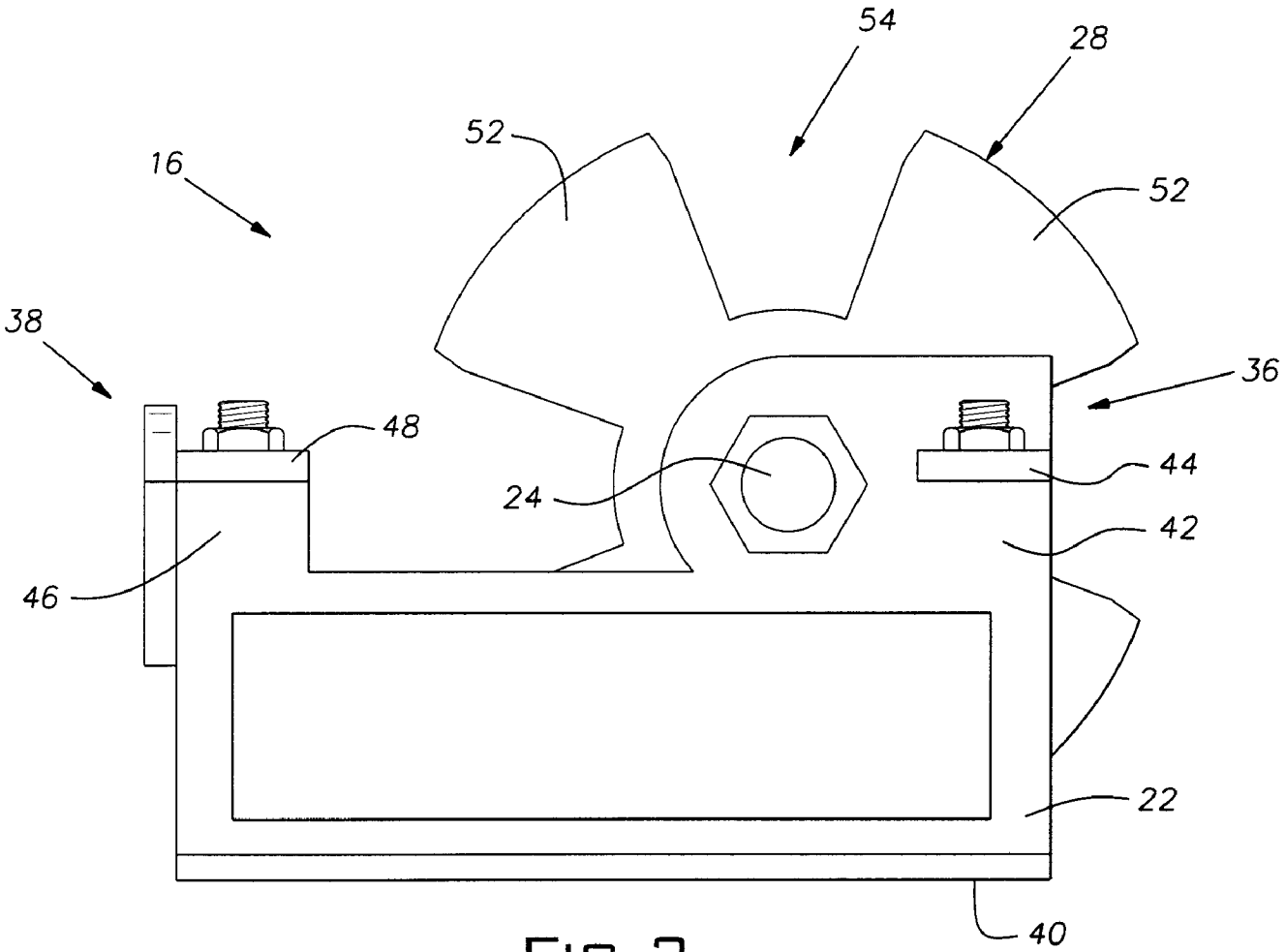
FIG. 3 is a rear view of the anti-backup device.
Figure 5:
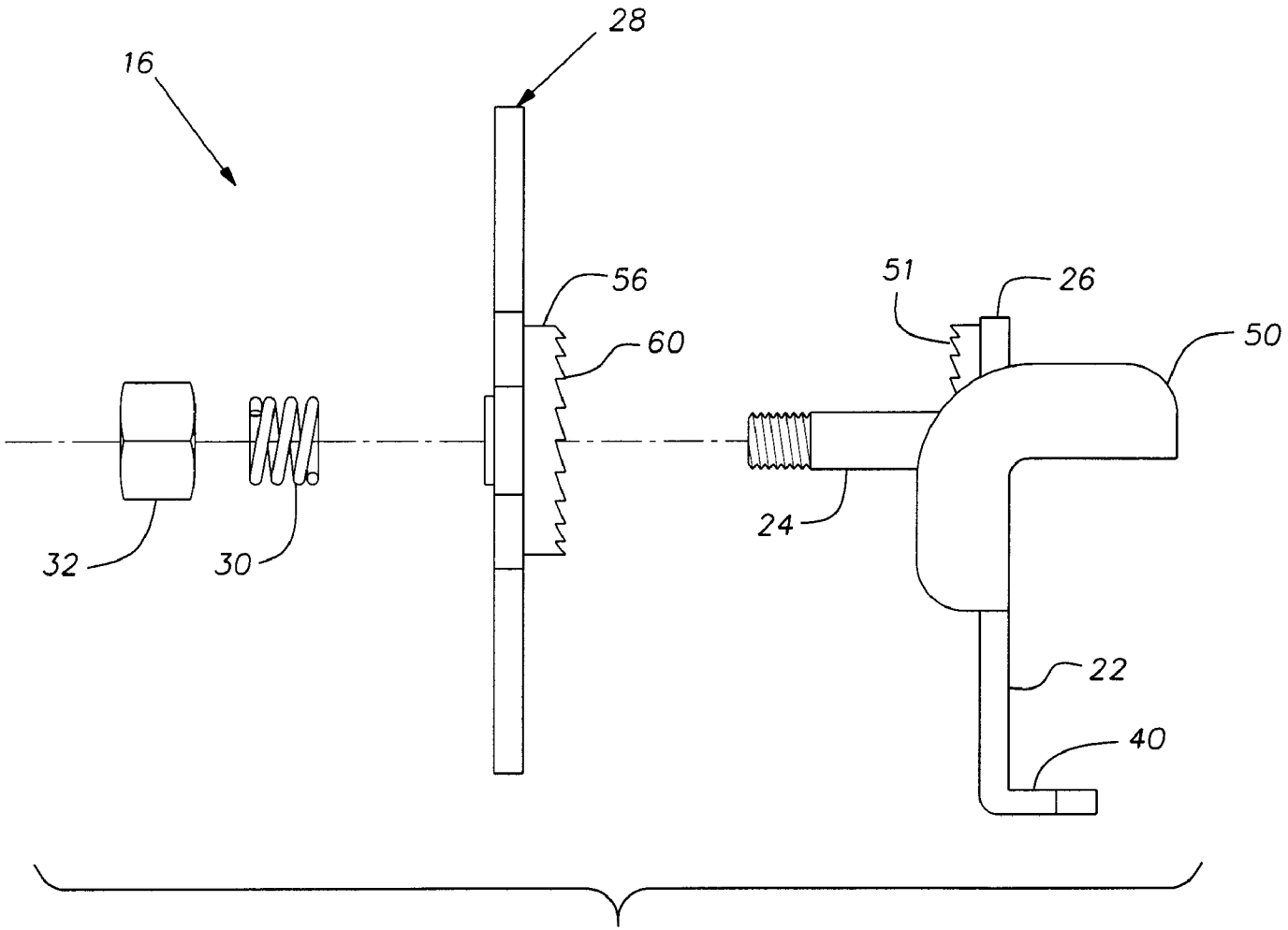
FIG. 5 is an exploded view of FIG. 4.

Referring now to the drawings, FIG. 1 shows a partial view of a power conveyor system 10 that includes a conveyor track 12, a motor driven conveyor chain 14, and a ratchet style anti-backup device 16. The conveyor chain 14 transports multiple conveyor dollies or carriers 18 (hereinafter "carrier 18") along the conveyor track 12. A trip pin 20 is located on a front portion of the carrier 18. The trip pin 20 engages the anti-backup device 16 to prevent the carriers 18 from moving in a reverse direction, as will be explained further below.

Referring to FIGS. 2-5, the anti-backup device 16, which is mounted in equally spaced intervals along the conveyor track 12, includes a mounting plate 22, a mounting shaft 24, a spline cut cog 26, a multi position cam 28, a bias spring 30, and a fastening device 32.

The mounting plate 22 is an integrated part that includes a flat plate portion 34, a front support 36, a rear support 38, and a bottom horizontal support 40 extending horizontally in a rearward direction from a bottom of the mounting plate 22. The front support 36 includes a first vertical portion 42 that extends vertically upward from a top of the flat plate portion 34. The front support 36 further includes a first horizontal connecting portion 44 that extends horizontally in a rearward direction from an approximate vertical center of the first vertical portion 42. The rear support 38 includes a second vertical portion 46 that extends vertically upward from the top of the flat plate portion 34 and a second horizontal connecting portion 48 extending horizontally in a rearward direction from a top of the second vertical portion 46. The front support 36 further includes a lip 50 for added strength.

It should be noted that the first vertical portion 42 extends vertically higher and is wider than the second vertical portion 46. Further, the first horizontal connecting portion 44 and the second horizontal connecting portion 48 are generally parallel and are on the same horizontal plane. In addition, the bottom horizontal support 40 is generally parallel to both the first horizontal connecting portion 44 and the second horizontal connecting portion 48. Thus, the mounting plate 22 has a generally U-shaped cross section.

The mounting plate 22 mounts to the conveyor track 12 via the front 36 and rear 38 supports with the first horizontal connecting portion 44 and the second horizontal connecting portion 48 attaching to a top of the conveyor track 12 and the bottom horizontal support 40 sliding under a bottom of the conveyor track 12 to prevent any upward movement of the mounting plate 22, see FIG. 1. It should be noted that the first horizontal connecting portion 44 and the second horizontal connecting portion 48 may be attached to the conveyor track 12 by any mechanical means known in the art, such as but not limited to, screws, rivets, etc.

Still referring to FIGS. 2-5, the mounting shaft 24 is attached to a front of to the second vertical portion 46 adjacent to the second horizontal connecting portion 48 and between the first horizontal connecting portion 44 and the second horizontal connecting portion 48. The mounting shaft 24 extends vertically outward from the second vertical portion 46 such that the mounting shaft 24 is essentially perpendicular to the mounting plate 22. The mounting shaft 24 receives the spline cut cog 26, the multi position cam 28, the bias spring 30, and the fastening device 32, as will be explained further below. The mounting shaft may be connected to the second vertical portion 46 any mechanical means, such as but not limited to, welding, etc.

The spline cut cog 26 is similar to that of a crown gear, which is a form of a bevel gear, in that multiple teeth 51 project at a right angle from a plane of the spline cut cog 26. Specifically, the teeth 51 project at a right angle from a front surface of the spline cut cog 26. An opening is defined at the center and the rear surface of the spline cut cog 26 is flat. The teeth 51 are cut in the shape of a right triangle with a straight edge and a sloped edge. The spline cut cog 26 slides over the mounting shaft 24 until the rear flat surface contacts the mounting plate 24. The spline cut cog 26 is fixedly attached to the anti-backup device 16 such that the spline cut cog 26 cannot rotate. The spline cut cog can be fixedly attached to either the mounting plate 22 or the mounting shaft 24 and may be connected by any means mechanical means known in the art, such as but not limited to welding, etc. As an alternative, the spline cut cog 26 can be keyed with respect to the mounting shaft 24 to thereby prevent rotation.

The multi position cam 28 is rotatably mounted to the mounting shaft 24 and includes multiple prongs 52 radially extending from a center of the cam 28. The prongs 52 are equally spaced around the cam 28 thereby forming valleys or openings 54 between adjacent prongs 52. The openings 54 receive the trip pin 20 from the carrier 18 thereby engaging the cam 28 to regulate the movement of the carrier 18, as will be explained further below.

The cam 28 further includes a hub 56 extending out from a rear side of the cam 28. The hub 56 has multiple teeth 60 projecting at a right angle from a plane of the cam 28. Specifically, the teeth 60 project at a right angle from a rear surface of the hub 56. The teeth 60 are cut in the shape of a right triangle similar to the teeth 51 on the spline cut cog 26 such that the teeth 60 on the hub 56 engage the teeth 51 on the spline cut cog 26. Thus, the teeth 60 on the hub 56 have a straight edge and a sloped edge, which engage the straight edge and sloped edge respectively on the teeth 51 on the spline cut cog 26 to regulate the movement of the carrier 18, as will be explained further below.

The bias spring 30 is a compression type spring and mounts on the mounting shaft 24 such that one end of the bias spring 30 contacts a front side of the cam 28. The bias spring 30 is compressed against the cam 28 with the fastening device 32. in the embodiment shown in the figures the fastening device 32 is a bolt or nut that threads on to the end of the mounting shaft 24, however, the fastening device may be any type of mechanical fastening device commonly known in the art, such as but not limited to, a cotter pin arrangement, a cap type arrangement, etc. As the fastening device 32 is rotated in a tightening direction the bias spring 30 is forced against the cam 28 such that the teeth 60 on the cam 28 engage the teeth 51 on the spline cut cog 26 to thereby regulate movement of the carrier 18, as will be subsequently described.

As mentioned above, multiple anti-backup devices 16 are mounted in equally spaced intervals along the conveyor track 12. The anti-backup devices 16 are spaced such that when the carriers 18 are at rest (not in motion) the trip pin 20 located at the front end of the carrier 18 has engaged a cam 28. In other words, when the carriers 18 are not in motion the trip pin 20 will be positioned in any given opening 54 between adjacent prongs 52 on the cam 28.

During operation of the conveyor system 10, as the carriers 18 move in a forward direction along the conveyor track 12 the trip pin 20 periodically engages the cam 28 on the anti-backup devices 16 thereby causing the cam 28 to rotate in a forward direction. Because the sloped edge of both the teeth 51 on the spline cut cog 26 and the teeth 60 on the cam 28 are sloped in a forward direction the cam 28 can rotate in a forward direction. Thus, during forward rotation of the cam 28, due to the sloped orientation of both sets of teeth 51, 60 the cam 28 is pushed in an outward direction away from the mounting plate 22 against the bias spring 30. After the slopes of the teeth 51, 60 disengage the bias spring 30 biases the cam 28 back toward the mounting plate 22 and the next set of teeth 51, 60 then become engaged. This type of movement of the cam 28 allows the cam 28 to rotate in a forward direction thereby allowing the carriers 18 to move in a forward direction along the conveyor track 12.

On the other hand, when the carriers are not in motion the anti-backup device 16 prevents the carriers 18 from moving in a backward direction thereby preventing contact and possible damage to the carriers 18. In other words, if the cam 28 begins to rotate in a backward direction the straight edge on the teeth 51 of the spline cut cog 26 and the straight edge on the teeth 60 of the cam 28 contact each other thereby preventing backward rotation of the cam 28. Thus, because the trip pin 20 is positioned in the opening 54 between adjacent prongs 52 on the cam 28 the carriers 18 cannot move in a backward direction thereby preventing contact and possible damage to the carriers 18.

The advantage of the present invention is that the present invention allows movement of the carriers in a forward intended direction while simultaneously preventing movement of the carriers in a backward unintended direction. Thus, the present invention prevents inadvertent slamming and contact between the carriers thereby preventing damage to the carriers.

While specific embodiments of the invention have been described and illustrated, it is to be understood that these embodiments are provided by way of example only and that the invention is not to be construed as being limited but only by proper scope of the following claims.

What is claimed is:

1. A power conveyor device for a power conveyor system comprising:

a mounting plate removably attached to a conveyor track;

a mounting shaft fixedly connected to the mounting plate;

a bevel gear fixedly and non-movably attached to the mounting shaft such that the bevel gear does not rotate relative to the mounting plate, the bevel gear having multiple teeth projecting out at a right angle from a front surface of the bevel gear;

a multi-position cam rotatably attached to the mounting shaft, the multi-position cam having multiple teeth projecting out at a right angle from a rear side of the multi-position cam;

a bias spring mounted on the mounting shaft to bias the multi-position cam against the bevel gear; and wherein the multi-position cam rotates only in a forward direction.

2. The conveyor device of claim 1, wherein the multiple teeth on the bevel gear are cut in the shape of a right triangle having a straight edge and a sloped edge, wherein the teeth on the multi-position cam are cut in the shape of a right triangle having a straight edge and a sloped edge, wherein the sloped edge on the teeth of the bevel gear engages the sloped edge on the teeth on the multi-position cam, and wherein the straight edge on the teeth of the bevel gear engages the straight edge on the teeth of the multi-position cam.

3. The conveyor device of claim 2, wherein during forward rotation of the multi-position cam the sloped edge of the teeth on the bevel gear and the sloped edge of the teeth of the multi-position cam force the multi-position cam outward away from the mounting plate and against the bias spring, wherein when the sloped edges disengage the bias spring forces the multi-position cam toward the mounting plate and the sloped edges of the next set of teeth become engaged.

4. The conveyor device of claim 3, wherein during an attempted rotation of the multi-position cam in a backward direction the straight edge of the teeth on the bevel gear and the straight edge of the teeth on the multi-position cam become engaged thereby preventing rotation of the multi-position cam in the backward direction.

5. The conveyor device of claim 4, wherein the multi-position cam includes multiple prongs and openings defined between adjacent prongs and wherein the openings receive a trip pin located on a front portion of a conveyor carrier.

6. The conveyor device of claim 1, wherein the mounting plate includes a first horizontal connecting portion operatively connected to the conveyor track, a second horizontal connecting portion operatively connected to the conveyor track, and a bottom horizontal support that slides under the conveyor track, wherein the first horizontal connecting portion and the second horizontal connecting portion are on the same horizontal plane, and wherein the first horizontal connecting portion and the second horizontal connecting portion are generally parallel to the bottom horizontal support.

7. The conveyor device of claim 1, wherein the bias spring is mounted on a distal end portion of the mounting shaft and engages a front side of the multi-position cam.

8. The conveyor device of claim 1 wherein the mounting shaft is non-rotatably fixed to the mounting plate.

9. The conveyor device of claim 1, wherein the multi-position cam includes multiple prongs and openings defined between adjacent prongs and wherein the openings receive a trip pin located on a front portion of a conveyor carrier.

10. An anti-backup device for a power conveyor system comprising:

a mounting plate removably attached to a conveyor track;

a mounting shaft fixedly connected to the mounting plate;

a spline cut cog fixedly attached to the mounting shaft, the spline cut cog having multiple teeth projecting out at a right angle from a front surface of the spline cut cog;

a multi-position cam rotatably attached to the mounting shaft, the multi-position cam having multiple teeth projecting out at a right angle from a rear side of the multi-position cam;

a bias spring mounted on the mounting shaft to bias the multi-position cam against the spline cut cog; and wherein the teeth on the multi-position cam engage the teeth on the spline cut cog in such a manner as to permit rotation of the multi-position cam in a forward direction and prevent rotation of the multi-position cam in a backward direction, wherein the multi-position cam includes multiple prongs and openings defined between adjacent prongs and wherein the openings receive a trip pin located on a front portion of a conveyor carrier.

11. The conveyor device of claim 10, wherein the multiple teeth on the spline cut cog are cut in the shape of a right triangle having a straight edge and a sloped edge, wherein the teeth on the multi-position cam are cut in the shape of a right triangle having a straight edge and a sloped edge, wherein the sloped edge on the teeth of the spline cut cog engages the sloped edge on the teeth on the multi-position cam, and wherein the straight edge on the teeth of the spline cut cog engages the straight edge on the teeth of the multi-position cam.

12. The conveyor device of claim 11, wherein during forward rotation of the multi-position cam the sloped edge of the teeth on the spline cut cog and the sloped edge of the teeth of the multi-position cam force the multi-position cam outward away from the mounting plate and against the bias spring, wherein when the sloped edges disengage the bias spring forces the multi-position cam toward the mounting plate and the sloped edges of the next set of teeth become engaged.

13. The conveyor device of claim 12, wherein during an attempted rotation of the multi-position cam in a backward direction the straight edge of the teeth on the spline cut cog and the straight edge of the teeth on the multi-position cam become engaged thereby preventing rotation of the multi-position cam in the backward direction.

14. The conveyor device of claim 10, wherein the mounting plate includes a first horizontal connecting portion operatively connected to the conveyor track, a second horizontal connecting portion operatively connected to the conveyor track, and a bottom horizontal support that slides under the conveyor track, wherein the first horizontal connecting portion and the second horizontal connecting portion are on the same horizontal plane, and wherein the first horizontal connecting portion and the second horizontal connecting portion are generally parallel to the bottom horizontal support.

15. The conveyor device of claim 10, further including a fastener to secure the multi-position cam and the bias spring to the mounting shaft.

16. A power conveyor device for a power conveyor system comprising:

a mounting plate removably attached to a conveyor track;

a mounting shaft fixedly connected to the mounting plate;

a bevel gear fixedly attached to the mounting shaft, the bevel gear having multiple teeth projecting out at a right angle from a front surface of the bevel gear;

a multi-position cam rotatably attached to the mounting shaft, the multi-position cam having multiple teeth projecting out at a right angle from a rear side of the multi-position cam, the multi-position cam including multiple prongs and openings defined between adjacent prongs and wherein the openings receive a trip pin located on a front portion of a conveyor carrier; and a bias spring operatively mounted on the mounting shaft to bias the multi-position cam against the bevel gear;

wherein the multi-position cam rotates only in a forward direction wherein the teeth on the bevel gear have a straight edge and a sloped edge and the teeth on the multi-position have a straight edge and a sloped edge, wherein the sloped edge on the teeth of the bevel gear engage the sloped edge on the teeth on the multi-position cam, and wherein the straight edge on the teeth of the bevel gear engage the straight edge on the teeth of the multi-position cam, wherein during forward rotation of the multi-position cam the sloped edge of the teeth on the bevel gear and the sloped edge of the teeth of the multi-position cam force the multi-position cam outward away from the mounting plate and against the bias spring, wherein when the sloped edges disengage the bias spring forces the multi-position cam toward the mounting plate and the sloped edges of the next set of teeth become engaged, and wherein during an attempted rotation of the multi-position cam in a backward direction the straight edge of the teeth on the bevel gear and the straight edge of the teeth on the multi-position cam become engaged thereby preventing rotation of the multi-position cam in the backward direction.

* * * * *